US006287147B1

(12) United States Patent
Lin

(10) Patent No.: US 6,287,147 B1
(45) Date of Patent: Sep. 11, 2001

(54) ELECTRICAL CONNECTOR WITH GROUNDING MEMBERS

(75) Inventor: Cheng Te Lin, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/532,451

(22) Filed: Mar. 23, 2000

(30) Foreign Application Priority Data

Mar. 24, 1999 (TW) ..... 88204447 U

(51) Int. Cl.[7] ..... H01R 13/648
(52) U.S. Cl. ..... 439/607
(58) Field of Search ..... 439/607, 69, 78, 439/79, 92, 101, 95, 610, 668, 540.1, 701, 731, 557, 862, 620

(56) References Cited

U.S. PATENT DOCUMENTS

| | | | | |
|---|---|---|---|---|
| 4,936,795 | * | 6/1990 | Kawai et al. | 439/609 |
| 5,281,169 | | 1/1994 | Kiat et al. . | |
| 5,676,569 | * | 10/1997 | Davis | 439/731 |
| 5,755,595 | * | 5/1998 | Davis et al. | 439/607 |
| 5,797,770 | * | 8/1998 | Davis et al. | 439/607 |
| 5,975,957 | * | 11/1999 | Noda et al. | 439/609 |
| 5,984,727 | * | 11/1999 | Wu et al. | 439/607 |
| 6,036,544 | * | 3/2000 | Brunber et al. | 439/607 |
| 6,053,773 | * | 4/2000 | Wu | 439/609 |

* cited by examiner

*Primary Examiner*—Neil Abrams
*Assistant Examiner*—J. F. Duverne

(57) ABSTRACT

An electrical connector 100 is provided which has first and second shield members 106, 108 which fit over an insulative housing 102. Housing 102 has a receptacle opening 110 for receiving a mated plug. Each of the two shield members 106, 108 is generally U-shaped, having a central mating panel 134, 142 and a pair of opposed side panels 136, 138 and 144, 146. The two shield members 106, 108 fit over housing 102 so that the two mating panels 134, 142 overlap. Side panels 136, 138 and 144, 146 of the two shield members 106, 108 are disposed against four respective sides of the housing, providing substantial shielding of the connector. In an embodiment, each of the two shield members 106, 108 includes a pair of ground contacts 156, 158, each of the ground contacts 156, 158 projecting from a respective one of the side panels into receptacle opening 110. In another embodiment, each of the side panels 136, 138 and 144, 146 includes a pair of locking tabs 152, 154 which project from a lower edge of the panel and are bent inwardly under the mounting side of housing 102. In a further embodiment, each of the side panels 136, 138 and 144, 146 includes a mounting leg 160, 162 for engaging through a respective aperture in a circuit board. Each of the U-shaped shield members 106, 108 may be formed from a generally strip-shaped blank, enabling an efficient use of materials with little waste.

16 Claims, 5 Drawing Sheets

ELECTRICAL CONNECTOR WITH GROUNDING MEMBERS

BACKGROUND OF THE INVENTION

The present invention generally relates to the art of electrical connectors and particularly relates to an electrical connector having a conductive shield.

Shielded connectors are generally known. A conventional connector generally includes an insulating housing, a receptacle defined within the housing, and a plurality of conductive terminals contained within the terminal cavities. The connector is configured so that a mating plug can be received by the receptacle for electrically contacting the terminals. The known housing is rectilinear in shape. Such a conventional connector additionally includes a conductive shield that substantially covers the insulating housing.

To provide shielding coverage around all four sides of the housing, as well as an upper mating side that receives the mated plug, the shield includes four side panels and a mating side. An aperture is defined in the mating side to provide access into the receptacle opening. The side panels may include mounting legs for fixing the connector to the circuit board. Many conventional shields are cut from a planar sheet as a blank that is folded to form four side panels and an upper mating panel.

It is desirable to establish a conductive contact between the shield and the mated plug that is received by the connector for further reducing noise and interference. In prior art connectors, such grounding contact has been inadequate.

Additionally, the shape of conventional shields has been rather complex, resulting in undesirable manufacturing inefficiencies. One conventional connector, for example, has a unitary shield formed from an generally T-shaped blank cut from a sheet, including a mating panel located in a center of the T-shaped blank. A strip comprised of a first, second and a third side panel extends from one edge of the mating panel, and a fourth side panel projecting from an opposite edge of the mating panel. A plurality of locking tabs and mounting legs project from these side panels, further complicating the overall shape of the flat shield blank. The shield is then formed generally into a box shape to encase the exterior of the insulative housing by bending each of the side panels perpendicularly. Unfortunately, when cutting a sheet to yield a plurality of shield blanks having such a complex shape, a significant amount of material is wasted, thus increasing manufacturing costs. Additionally, the folding process is cumbersome.

During manufacture, shields are typically plated prior to assembly with the housing. A plurality of the shields are placed together to be processed as a batch during the plating process. Unfortunately, the complex shield shape can cause the shields to become entangled with each another. Unless the entangled shields are carefully separated, the shields can be bent and deformed. Therefore, the complex shield shape requires the careful inspection and separation of the shields after plating. These steps further raise manufacturing costs.

Therefore, a need exists for a connector having improved grounding and having an effective electromagnetic shield that is less expensive to manufacture. A shield design is desirable which reduces wasted material and which is less susceptible to entangling with other shields.

SUMMARY OF THE INVENTION

The present invention overcomes the problems of prior connectors by providing an improved shield. For example, in an embodiment, the invention provides a connector including a conductive shield that has ground contacts to provide a conductive contact between the shield and a mated plug received in the connector. In an embodiment, the connector further includes ground pins for establishing improved grounding contact and mounting stability at the circuit board.

Additionally, the present invention provides an improved shape of the shield that reduces wasted material and avoiding potentially damaging entanglement of parts during manufacture. Instead cutting the shield in the shape of a T, the shield of the invention made from two strip-shaped members, thereby greatly reducing the amount of wasted material. Each of the strip-shaped members is bent in a U-shape forming a central mating panel and two sides panels perpendicularly extending therefrom. The two U-shaped shield members are secured over a generally cube-shaped or rectilinear housing such that each member covers two opposite side surfaces of the housing. Each of the four side panels may include a mounting leg. The central mating panels of the two shields overlap across a mating surface of the housing.

More specifically, in an embodiment, the present invention provides a shielded electrical connector including an insulative housing having a mating surface, a mounting surface, at least one side surface extending from the mating surface, and terminal cavities extending through the housing. The housing includes a plug receptacle opening that is accessible from the mating surface. Conductive terminals are disposed in the terminal cavities in the housing. Each of the terminals has a contact portion for mating with terminals of a mated plug and a tail portion for engaging conductors on a circuit board. Additionally, the connector includes a shield comprised of first and second shield members that substantially encase the housing. The first shield member includes a mating panel disposed on the mating surface of the housing and side panel covering a side surface of the housing and a second shield member including mating wall disposed on the mating panel of the first conductive shield and a side wall covering a side surface of the housing. The shield includes one or more resilient ground contacts that projects inwardly to contact against a mated plug received in the plug receptacle opening. The housing includes one or more respective cutout for access between the shield and the receptacle, each cutout providing a space to accommodate a corresponding one of the ground contacts.

In an embodiment, the first shield member and the second shield member together each includes two ground contacts, totaling four ground contacts evenly arranged around the plug to provide better improved shielding and grounding.

In an embodiment, the connector first and second shield members include a plurality of locking tabs. For example, an embodiment includes eight locking tabs. Each of the tabs is bent inwardly to lock on a bottom of insulating housing. The coupling strength between the housing and shield is thereby enhanced.

An advantage of the present invention is that it provides a shielded electrical connector that establishes a reliable, robust grounding connection between the electromagnetic shield and the mated plug received by the connector.

Another advantage of the present invention is that it provides an electrical connector having electromagnetic shields that can be manufactured inexpensively with little waste of material.

A further advantage of the present invention is that it provides an electrical connector which has a secure, grounded mount to a circuit board.

Yet another advantage of the present invention is that it provides an electrical connector having a shield that can be manufactured with low rates of damage and deformation.

A still further advantage of the present invention is that it provides a connector that is simple to manufacture and which has a shield that reduces the use of tools in assembling the shield members.

Additional features and advantages of the present invention are described in, and will be apparent from, the following detailed description, the claims and the Figures.

DETAILED DESCRIPTION OF THE PREFERRED EMBODIMENT

Figure 1:
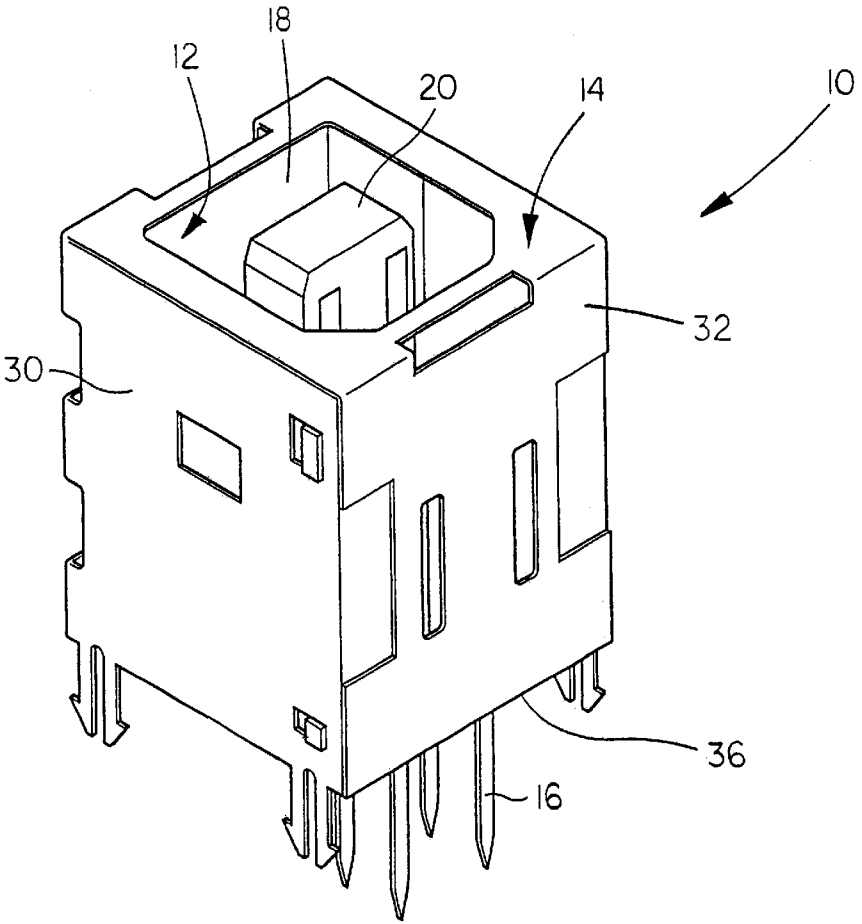
FIG. 1 (PRIOR ART)
FIG. 1 is a perspective view of a conventional shielded connector.

Now referring to the Figures, wherein like numerals designate like components, FIG. 1 illustrates a conventional connector 10, which generally includes an insulative housing 12, a shield 14, and a plurality of conductive terminals 16. A receptacle opening 18 is defined within the housing 12, shaped to receive a mated plug connector (not shown). The housing 12 includes a terminal platform 20 which projects upwardly within the receptacle opening 18, and terminal cavities are defined within the housing 12 and along the terminal platform 20. The conductive terminals 16 are disposed within the terminal cavities and are supported along the terminal platform 20.

Figure 2:
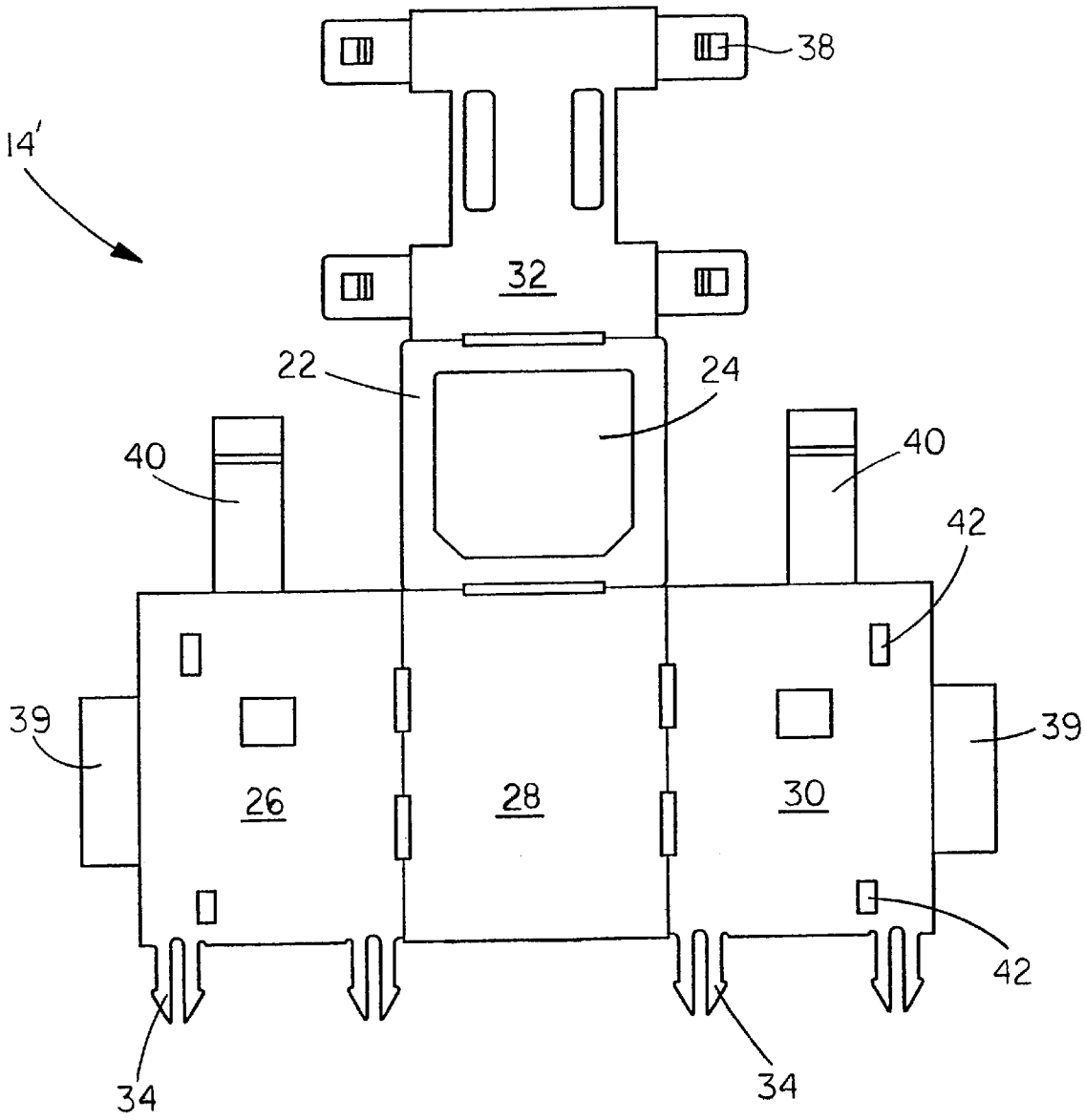
FIG. 2 (PRIOR ART)
FIG. 2 is an plan view of a conventional unitary blank prior to forming of the connector of FIG. 1 prior to folding.

The conventional shield 14 substantially covers four sides and an upper mating surface of the housing 12. The conventional shield 14 (FIG. 1) is formed of a unitary blank 14', as shown in FIG. 2. The blank 14' is generally T-shaped, having a centrally located mating panel 22 with an aperture 24 shaped to receive the mated plug. A series of three side panels 26, 28, 30 project from an edge of the mating panel 22, and a fourth side panel 32 projects from an opposite edge of the mating panel 22. Additionally, mounting legs 34 project from the side panels 26, 28, 30, 32 of the blank 14' in a direction toward a mounting side 36 (FIG. 1) of the connector 10 opposite the mating panel 22, panel-coupling tabs 38 project sideways from the side panel 32, a pair of flaps 39 project from the panels 26, 20, respectively, and a pair of ground contacts 40 project from the panels 26, 30. The shield 14 is formed by folding each of the side panels 26, 28, 30, 32 perpendicularly and by engaging the sideways-extending panel-coupling tabs 38 through a corresponding slot 42 in an adjacent one of the side panels 26, 30. The panel-coupling tabs 38 typically require bending by means of a tool. When the shield 14 is formed and assembled with the housing, as shown in FIG. 1, the mounting legs 34 project downwardly to engage a circuit board.

As illustrated in FIG. 2, the shape of the unitary shield blank 14' is complex. Unfortunately, a significant amount of material is wasted when cutting a sheet to yield a plurality of such blanks 14'. Moreover, the complex shape can cause a plurality of the blanks 14' to become entangled during manufacturing, particularly during a plating process.

Figure 3:
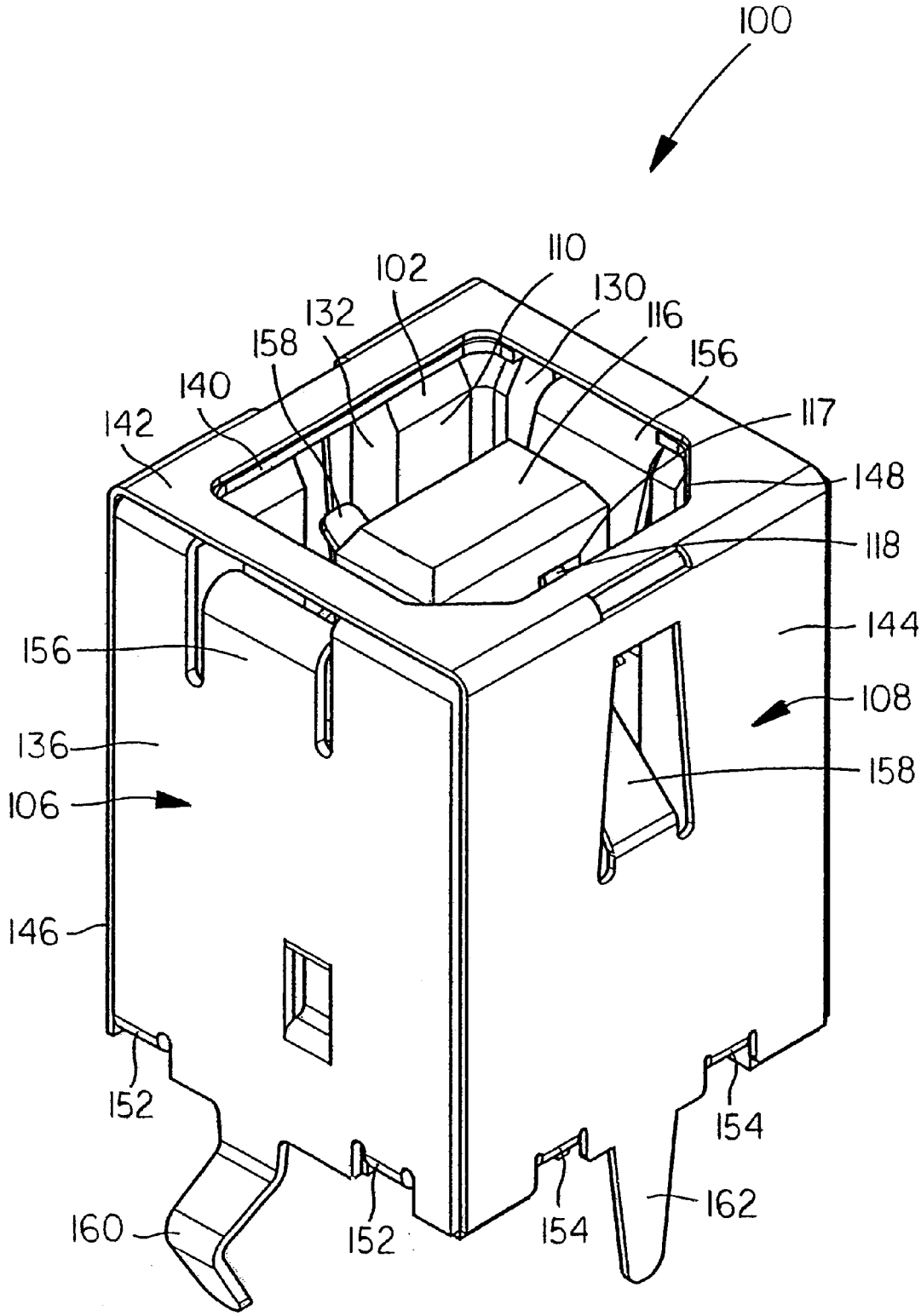
FIG. 3 is an upper perspective view of a connector constructed in accordance with an embodiment of the present invention.
Figure 4:
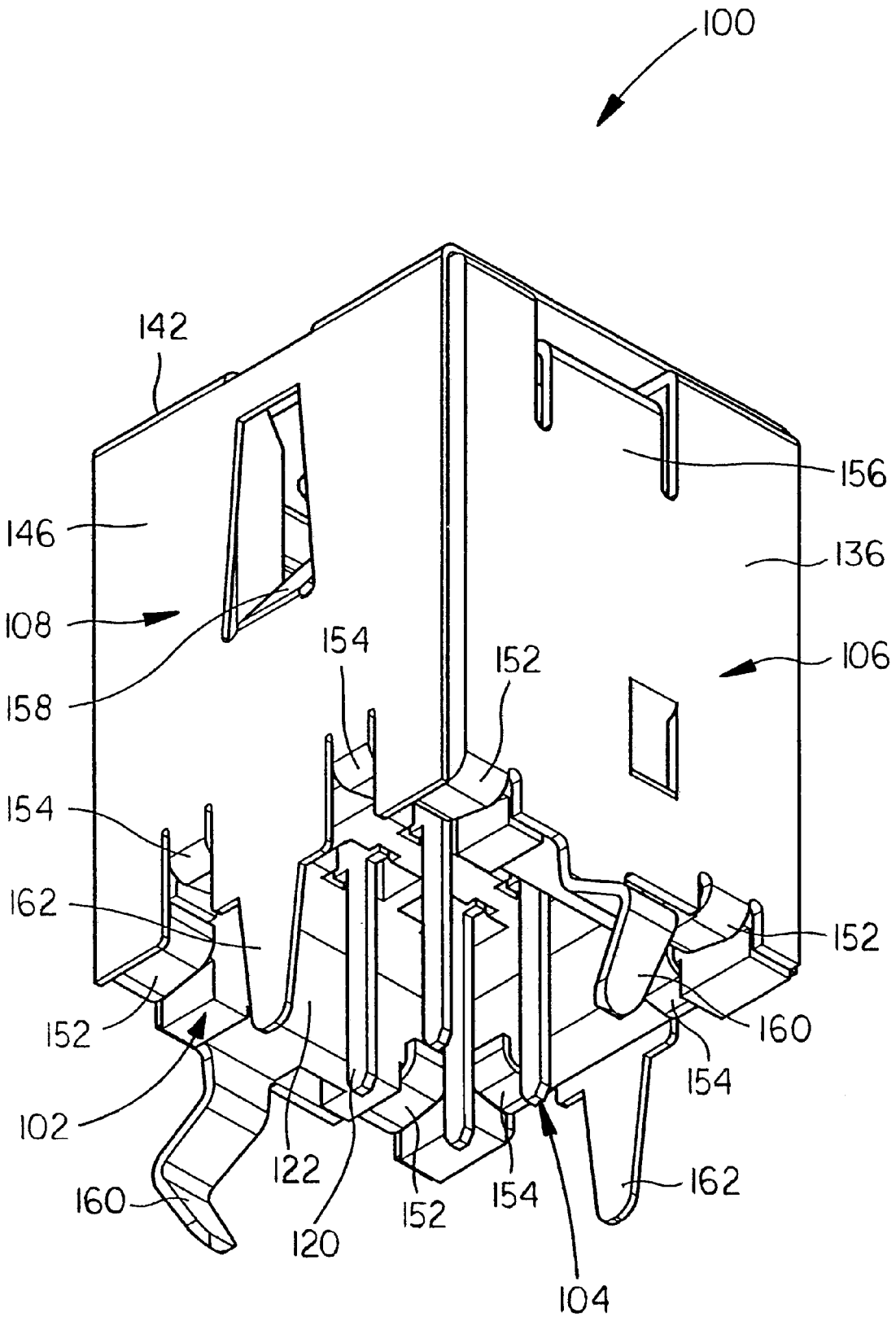
FIG. 4 is a another perspective view of connector of FIG. 3 from a lower, rotated perspective.
Figure 5:
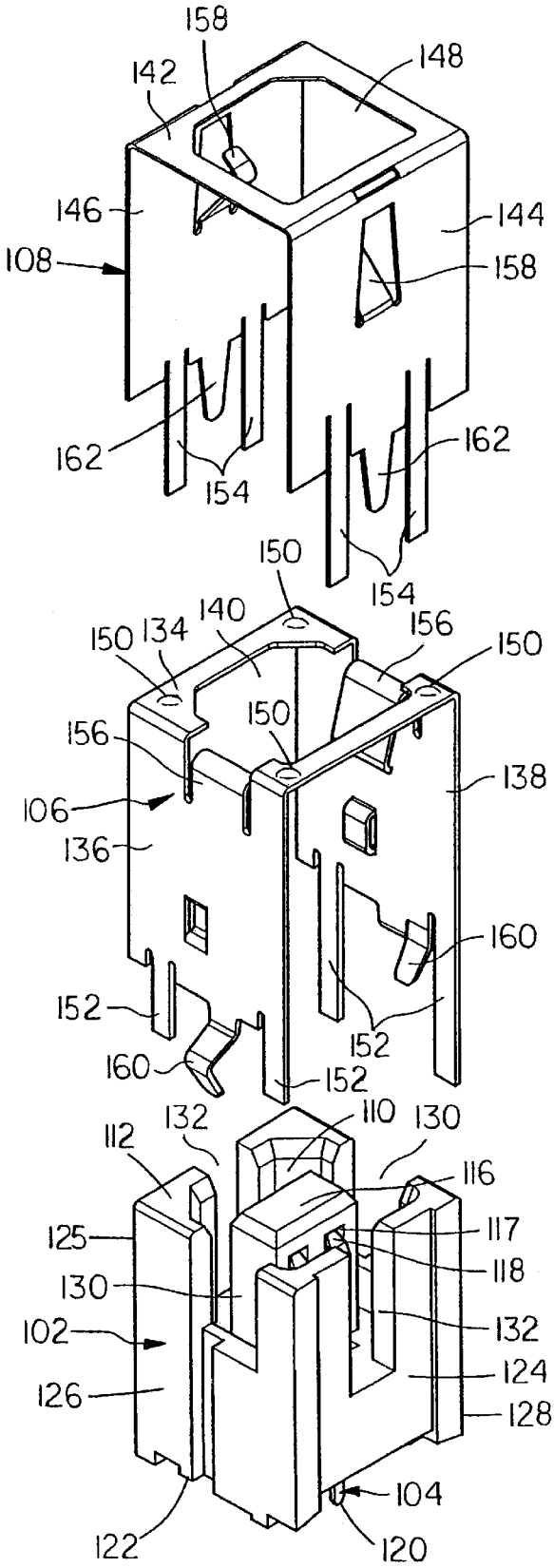
FIG. 5 is an exploded view of the connector of FIGS. 3 and 4.

Turning now to FIGS. 3, 4 and 5, a connector 100 is illustrated as constructed in accordance with teachings of the present invention. As illustrated in FIGS. 3 and 4, the assembled connector 100 is generally rectilinear in shape and is configured for mounting to a circuit board (not shown) and for receiving a mated plug (not shown).

As illustrated in FIG. 5, the connector 100 includes an insulative housing 102, a plurality of conductive terminals 104, a first conductive shield member 106 and a second conductive shield member 108. The housing 102 defines a receptacle opening 110 recessed from a mating side 112 of the housing 102 for receiving the mated plug. The housing 102 includes a terminal platform 116 that projects upwardly within the receptacle opening 110. A plurality of terminal cavities 117 are defined within the housing 102 and along the terminal platform 116 for supporting the conductive terminals 104.

Each of the conductive terminals 104 has a contact portion 118, as illustrated in FIGS. 3 and 5, disposed within the receptacle opening 110 for connecting with contacts of the mated plug. Additionally, as illustrated in FIGS. 4 and 5, each of the terminals 104 includes an opposite tail portion 120 which projects from the mounting surface 122 (FIG. 4), opposite the mating side 112 (FIGS. 3, 5), for engaging conductors of the circuit board.

As shown in FIG. 5, the illustrated housing 102 is generally rectilinear or cubical in shape, having the mounting side 122 opposite the mating side 112, a front side 124, a rear side 126 opposite the front side 124, and opposite left and right sides 126, 128, respectively. Cutouts 130 are defined at a central, upper portion of the front and rear of the housing 102 and cutouts 132 are also defined at the left and right of the housing.

For providing electromagnetic shielding, the first shield member 106 and second shield member 108 fit exteriorly over the housing 102. Each of the shield members 106, 108 is generally U-shaped and is formed from generally a strip-shaped blank that may be cut from a sheet (not shown). The strip shape (prior to bending into the illustrated U-shape) of the two shield members 106, 108 advantageously avoids wasting material, thereby reducing cost of manufacture. More particularly, the strip shape allows many of the shield members to be cut adjacently from a common sheet with a relatively small area of wasted, unused material between the shield members.

As illustrated in FIG. 5, the first shield member 106 includes a central mating panel 134 and left and right side panels 136, 138, respectively that extend perpendicularly from opposite edges of the mating panel 134. An aperture 140 is disposed in the mating panel 134 shaped to provide plug access to the receptacle opening 110 of the housing 102. The first shield member 106 fits over the housing 106 so that the mating panel 134 is disposed against the mating side 112 of the housing 102. The left and right side panels 136, 138 of the first shield member 106 are disposed against the left and right sides 126, 128 of the housing 102, respectively.

Referring again to FIG. 5, the second shield member 108 includes a central mating panel 142 and front and rear side panels 144, 146, respectively, that extend perpendicularly from opposite sides of the mating panel 142. An aperture 148 is disposed in the mating panel 142 shaped to provide plug access to the receptacle opening 110 defined in the housing 102. The second shield member 108 fits over a portion of the first shield member 106 and the housing 102. More specifically, the mating panel 142 of the second shield member 108 is disposed against the mating panel 134 of the first shield member 106 in an overlapping manner, and the front and rear side panels 144, 146 are disposed against the opposed sides of the housing 102, respectively. The apertures 140, 148 correspond in shape and alignment to accommodate insertion of the mated plug. Thus, the housing 102 is substantially shielded, the two shield members 106, 108 covering the four lateral sides 124, 125, 126, 128 of the housing 102 as well as the mating side 112 of the housing 102.

Optionally, the mating panel 134 of the first shield member 106 includes one or more upwardly-extending bumps 150, as shown in FIG. 5. The bump 150 engages upwardly against an underside of the mating panel 142 of the second shield member 108, when assembled. The bump 150 ensures good contact between the first and second shield members 106, 108. Alternatively or additionally, one or more downwardly-extending bumps may be formed in the second shield member 108 to engage against an upper side of the mating panel 134 of the first shield member 106.

For securing the shield members 106, 108 to the housing 102, the first and second shield members 106, 108 each includes a plurality of locking tabs that project from a bottom edge each of the side panels 136, 138, 144, 146. More particularly, in the illustrated embodiment, the first shield member 106 includes a pair of first locking tabs 152 that project downwardly from each of the left and right side panels 136, 138 respectively. Also, on the second shield member 108, a pair of second locking tabs 154 project downwardly from each of the front and rear panels 144, 146. Each of the first and second locking tabs 152, 154 is bent inwardly under the mounting side 122 of the housing 102, as shown in FIG. 4, thereby securely mounting each of the shield members 106, 108 to the housing 102. The location of each of these locking tabs 152, 154 at the bottom edge of the connector 100 is advantageous in that fewer tools and steps are required to secure the shield members 106, 108 to the housing 102. When the first and second shield members 106, 108 are assembled with the housing, as shown in FIGS. 3 and 4, the housing 102 is substantially covered, except for the mounting side 122, thereby providing good electromagnetic shielding.

In order to provide a robust grounding connection between the connector 100 and the mated plug, each of the two shield members 106 and 108 includes a pair of ground contacts for establishing conductivity to the mated plug. In an embodiment, each of the ground contacts is a resilient strip-like projection that extends inwardly from a respective one of the side panels to contactably bias against the inserted plug.

Specifically, the first shield member 106 has a pair of resilient first ground contacts 156, and the second shield member 108 has a pair of second resilient ground contacts 158. The first ground contacts 156 project from an upper edge of each of the left and right side panels 126, 128 and are bent inwardly over to project generally downwardly. Each of the first ground contacts 156 projects inwardly through a respective one of the cutouts 130 in the housing 102. The second ground contacts 158 are cut centrally the front and rear side panels 144, 146, respectively, and bent inwardly to project generally upwardly. Each of the second ground contacts 158 projects inwardly through a respective one of the cutouts 132 in the housing 102. The ground contacts 156, 158 may be formed in various shapes. Each of the four ground contacts projects slightly into the receptacle opening 110 near the mating panels 134, 142 for contacting against a shield of a mated plug received in the connector 100.

For mounting the connector 100 to the circuit board, the first shield member 106 has a pair of first mounting legs 160. One of the first mounting legs 160 projects downwardly from each of the left and right side panels 136, 138. The second shield member 108 has a pair of second mounting legs 162. Each of the second mounting legs 162 projects downwardly from a respective one of the front and rear side panels 144, 146. The first and second mounting legs 160, 162 are inserted into a respective retaining aperture in the circuit board to securely mount the connector 100 and to ground the first and second shield members 106, 108 to the circuit board. In the illustrated embodiment, the second mounting legs 162 are generally straight, residing in a plane common with the respective front and rear side panels 144, 146. Also, in the illustrated embodiment, each of the first mounting legs 160 is bent in a serpentine manner so that each of the retaining legs 160 generally has a V-shape.

Although the mating panels 134, 142 of the two respective shield members 106, 108 overlap, the amount of overlapping material is favorable from a cost-of-manufacture perspective in comparison to the amount of waste experienced in producing prior art shaped shields 14, 14' (FIGS. 1 and 2) or prior art cross-shaped shields. Advantageously, in a connector 100 according to the invention, the overlapping panels provide enhanced shielding of the mating surface.

The first and second shield members 106, 108, further provide the connector 100 with improved structural strength with fewer entangling points in comparison to prior art connectors. Moreover, in an embodiment, the first and second shield members 106, 108 can be assembled so that their respective side panels 126, 128, 144, 146 are generally in the same downward orientation, thereby requiring less use of tools and reducing the assembly time. Additionally the simple design avoids previous complex shapes, thereby avoiding entanglement and damage, enhancing plating efficiency, and increasing the quality of production. Lastly, the ground contacts provide greater conductive contact between both shield members 106, 108 and the shield of the mated connector.

Although the present invention has been described with reference to a preferred embodiment, it should be understood that the invention is not limited to the details thereof Various changes and modifications to the described embodiment have been suggested in the foregoing description and others will be apparent to those of ordinary skill in the art. Such changes and modifications may be made without departing from the spirit and scope of the present invention. Therefore, all such changes and modifications are intended to be embraced within the scope of the invention as defined in the appended claims.

What is claimed is:

1. An electrical connector comprising:

an insulative housing including a mating side, a mounting side, a plurality of lateral sides extending from the mating side defining a receptacle in the mating side for receiving a mated plug in said receptacle, and a plurality of terminal cavities extending through the housing;

a plurality of conductive terminals disposed in the respective terminal cavities, each of the terminals having a contact portion for mating with terminals of the mated plug and tail portions for engaging conductors on a circuit board; and first and second conductive shield members mounted against an exterior of the housing, each of the shield members including a mating panel with an opening therein and at least one side panel extending generally perpendicularly from the mating panel, both the first and second mating panels covering the mating side of the housing, and each side panel covering a respective one of the lateral sides of the housing;

the first shield member including a resilient first ground contact, the first ground contact being integral with the side panel and projecting into the receptacle to contact the mated plug; and the second shield member including a resilient second ground contact, the second ground contact being integral with the side panel and projecting into the receptacle to contact the mated plug.

2. The connector of claim 1, wherein the lateral side of the housing includes a respective cutout to accommodate a respective one of the ground contacts.

3. The connector of claim 1, wherein the first shield member is generally U-shaped wherein the opposed side panels respectively cover opposite sides of the housing.

4. The connector of claim 1, wherein the second shield member is generally U-shaped wherein the opposed side panels respectively cover opposite sides of the housing.

5. The connector of claim 1, wherein the first ground contact projects from an upper edge of a respective one of the two opposed side panels and is bent inwardly to project at a generally downward angle into said receptacle opening.

6. The connector of claim 1, wherein the second ground contact is defined by a cut in a respective one of the two opposed side panels and is bent inwardly to project at a generally upward angle into said receptacle.

7. The connector of claim 1, wherein the side panel of the shield member includes a pair of locking tabs projecting from a lower edge of the respective side panel, each of the locking tabs being bent under the mounting side of the housing to secure the respective shield member to the housing.

8. The connector of claim 1, wherein the first and second conductive shields each includes a mounting leg, each of the mounting legs projecting downwardly from a respective one of the side panels for engagement with the circuit board.

9. The connector of claim 2, wherein each ground contact extends through the receptive cut out into the receptacle.

10. The connector of claim 1, wherein each of said first and second shield members includes a pair of opposed side panels each with resilient first and second ground contacts.

11. An electrical connector comprising:

an insulative housing having a mating side, a mounting side opposite the mating side, a first pair of opposed lateral sides and a second pair of opposed lateral sides extending from the mating side to the mounting side to define a receptacle, an opening in the mating side for receiving a mated plug connector, a terminal platform, and terminal cavities along the terminal platform;

a plurality of terminals disposed in the respective terminal cavities in the housing, each of the terminals having a contact portion for mating with terminals of the mated plug connector and a tail portion for engaging conductors on a circuit board;

first and second U-shaped shield members, each of the shield members including a mating panel with an opening therein, said mating panel covering the mating side of the housing, and a pair of opposed side panels, the side panels of each of the shield members covering a respective pair of the opposed lateral sides of the housing;

the first shield member including a pair of first mounting legs, each of the first mounting legs projecting downwardly from a respective one of the opposed side panels for engaging a corresponding aperture in a circuit board; and the second shield member including a pair of second mounting legs, each of the second mounting legs projecting downwardly from a respective one of the opposed side panels for engaging a corresponding aperture in a circuit board.

12. The connector of claim 11, wherein each of the first mounting legs is bent in a serpentine shape.

13. The connector of claim 11, wherein each of the first mounting legs has at least two bends so that the mounting leg is generally V-shaped.

14. The connector of claim 11, wherein each of the first and second shield members includes a pair of ground contacts for contacting against the mated connector received in the receptacle opening.

15. An electrical connector comprising:

an insulative housing having a mating side, a mounting side opposite the mating side, and a plurality of sides extending between the mating side and the mounting side to define a receptacle, an opening in the mating side for receiving a mated plug connector, a terminal platform projecting within the receptacle, and terminal cavities along the terminal platform;

a plurality of terminals respectively disposed in the terminal cavities in the housing, each of the terminals having a contact portion for mating with terminals of the mated plug and a tail portion for engaging corresponding conductors on a circuit board; and first and second shield members covering sides of the housing, each of the shield members including a mating panel with an opening therein, the mating panel covering the mating side of the housing and a pair of opposed side panels, each of the side panels covering a respective one of the sides of the housing, the first and second shield members each including two pairs of locking tabs, each pair of locking tabs projecting downwardly from a respective one of the side panels and being bent inwardly under the mounting side of the housing to secure the respective shield members to the housing.

16. The connector of claim 15, wherein each of the first and second shield members includes a pair of ground contacts for contacting against the mated connector received in the receptacle.

* * * * *